US012070793B1

(12) United States Patent
Carlson

(10) Patent No.: US 12,070,793 B1
(45) Date of Patent: Aug. 27, 2024

(54) FRANGIBLE-SOLUBLE CASTING CORES AND METHODS OF MAKING THE SAME

(71) Applicant: National Technology & Engineering Solutions of Sandia, LLC, Albuquerque, NM (US)

(72) Inventor: Matthew D. Carlson, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 17/011,149

(22) Filed: Sep. 3, 2020

Related U.S. Application Data

(60) Provisional application No. 62/895,296, filed on Sep. 3, 2019.

(51) Int. Cl.

| | |
|---|---|
| ***B22C 9/10*** | (2006.01) |
| ***B22C 1/14*** | (2006.01) |
| ***B22C 1/18*** | (2006.01) |
| ***B22D 29/00*** | (2006.01) |

(52) U.S. Cl.
CPC ..... *B22C 9/10* (2013.01); *B22C 1/14* (2013.01); *B22C 1/181* (2013.01); *B22D 29/001* (2013.01)

(58) Field of Classification Search
CPC .... B22C 9/10; B22C 1/14; B22C 1/18; B22C 1/181; B22D 27/04; B22D 29/00; B22D 29/001
USPC ..... 164/369, 122, 132
See application file for complete search history.

(56) References Cited

U.S. PATENT DOCUMENTS 5,577,550 A * 11/1996 Schmidt ..... B22C 7/02 164/132

* cited by examiner

*Primary Examiner* — Kevin P Kerns
(74) *Attorney, Agent, or Firm* — Daniel J. Jenkins

(57) ABSTRACT

The casting material may be formed around the casting core using a variety of conventional casting techniques including direct liquid metal infiltration, pressure assisted casting, and centrifugal casting among others.

8 Claims, 9 Drawing Sheets

DETAIL A

FRANGIBLE-SOLUBLE CASTING CORES AND METHODS OF MAKING THE SAME

CROSS-REFERENCE TO RELATED PATENT APPLICATIONS

This patent application claims priority from and the benefit of U.S. Provisional Patent Application Ser. No. 62/895,296, filed Sep. 3, 2019, entitled "FRANGIBLE-SOLUBLE CASTING CORES AND METHODS OF MAKING THE SAME," which is hereby incorporated by reference in its entirety.

STATEMENT OF GOVERNMENT INTEREST

The United States Government has rights in this invention pursuant to Contract No. DE-NA0003525 between the United State Department of Energy and National Technology & Engineering Solutions of Sandia, LLC, both for the operation of the Sandia National Laboratories.

FIELD

The present disclosure is generally directed to casting fabrication, and more particularly directed to systems and methods for facilitating the removal of a casting core from a cast article.

BACKGROUND

Molded shapes can be formed by casting processes that include forming a casting core, forming a cast part around the casting core, and removing the casting core to form a casting having at least some internal shape, passage, or other features that are created by the removal of the casting core. Relatively large casting cores or those used to create highly porous parts may be removed by mechanical means (i.e., porous foams), while casting cores for long, thin, or complex shapes must be removed by chemical means with dissolution rates limiting the overall dimensions of the part.

In the field of heat exchanger manufacturing, printed circuit heat exchangers (PCHEs) offer extremely high performance in a compact volume but suffer from high costs and the weight of extraneous material due to limitations in the chemical etching process. Heat exchangers manufactured using direct metal laser sintering (DMLS) and similar methods can produce better geometries than is possible with PCHEs, but current additive manufacturing (AM) techniques exhibit porosity in the final metal part and the potential inclusion of weld defects. Brazing and transient liquid phase (TLP) bonding techniques used to produce high-temperature plate-fin heat exchangers (PFHEs) introduce additional materials and the process leaves residual stresses in the joints upon cooling, which, in addition to manufacturing limitations for corrugated plates, limit their pressure containment potential. Finally, shell and micro-tube units with laser-welded tube sheets suffer from complex header and manifolding arrangements and significant risks of flow-induced vibration in the high aspect-ratio tubes. All current manufacturing methods also suffer from a critical dependence on the development of a mature supply chain for the respective product forms (plates, tubes, etc.) and material-specific development for the manufacturing processes used.

What is needed are casting cores and casting processes that overcome these and other deficiencies.

SUMMARY OF THE DISCLOSURE

The present disclosure is directed to a frangible casting core that includes a material formed into a frangible casting core porous geometry. The porosity of the casting core is between 20% and 60% and any single casting core segment aspect ratio is at most 10:1.

The present disclosure is further directed to a casting system that includes a frangible casting core formed by a material and defining the internal structure of a final part, a mold defining the outer geometry of the final part, and a void space between the casting core and the mold filled by a molten casting material. The frangible core is fractured by pressure applied by the molten cast material as the cast material cools, and the local metal thickness around the casting core is at least equal to the width of the casting core.

The present disclosure is further directed to a method of forming a component that includes the following steps, forming a heated cast material around a frangible core formed of a core material, cooling the heated cast material whereby the difference in the coefficients of thermal expansion between the cast material and the core material fractures the frangible core. The thermal expansion coefficient of the casting core is at most 80% that of the cast material, and the local metal thickness around the casting core is at least equal to the width of the casting core An advantage of the present disclosure is that long, thin, or complex casting cores that are impractical to remove using conventional means due to limited physical access and high ratios of length to diameter which limit dissolution rates are more easily removed.

Another advantage of the present disclosure is that the parts produced using long, thin, or complex casting cores can feature the same complexity of internal geometry realizable from additive manufacturing techniques.

Another advantage of the present disclosure is that casting processes are typically the first manufacturing method developed for a new metal alloy, and therefore parts can be immediately created without the need to develop manufacturing processes to create other product forms (i.e. plates, tubes, powder, etc.).

Alternative exemplary embodiments relate to other features and combinations of features as may be generally recited in the claims.

DETAILED DESCRIPTION

Figure 1:
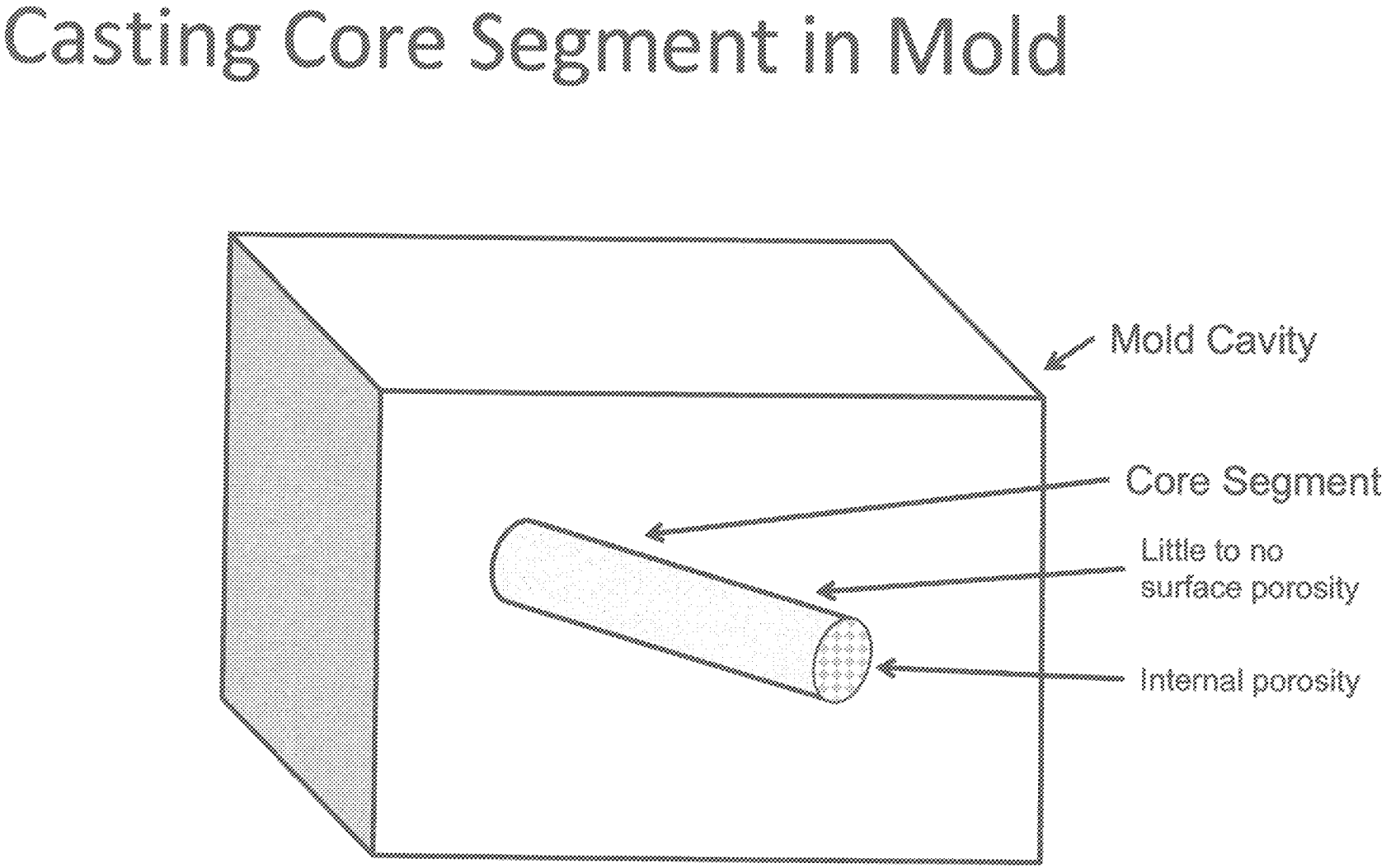
FIG. 1 illustrates a first step of the casting process according to an embodiment of the disclosure.

The present invention will now be described more fully hereinafter with reference to the accompanying drawings, in which preferred embodiments of the invention are shown. This invention may, however, be embodied in many different forms and should not be construed as limited to the embodiments set forth herein: rather, these embodiments are provided so that this disclosure will be thorough and complete and will fully convey the scope of the invention to those skilled in the art.

The present disclosure is directed to casting systems and methods that include casting cores designed to crush under a specified amount of strain applied to the core in the casting process. In particular, molten metal forming the desired part is cast at low pressure around a frangible casting cores, and as high thermal strain is applied to the core from the article/block during the cooling process due to dissimilar rates of thermal expansion, the casting cores break, crack, crush or otherwise fracture, hereafter collectively referred to as fracture, into smaller pieces to facilitate removal of the casting core material.

The casting material may be formed around the casting core using a variety of convention casting techniques including direct liquid metal infiltration, pressure assisted casting, and centrifugal casting among others.

The present disclosure is also directed to casting methods that utilize the disclosed novel cores, arrangements and processes to form cast components. The cast component may be any suitable component casting that includes small, complex internal passages. In an embodiment, cast components may include, but are not limited to heat exchangers, chemical reactors, injection molding dies, engine blocks, rocket nozzle injector plates, and assemblies of components in a single article such as a complete chemical unit process including heat exchangers, filters, mixers, etc. In an embodiment, the casting cores may be used to form highly interconnected passages within the casting, wherein the highly inter-connected cores provide mechanical integrity to the core. In an embodiment the casting core material is designed in the casting arrangement or system to crush, break or fracture (collectively referred to as fracture) under stress and/or strain applied to the core by the cooling of the casting. In an embodiment, the fractured cores are removed by various core removal processes, such as, but not limited to mechanical flushing using high pressure liquid, dissolution by chemical solvents, and the use of particle-laden liquid similar to sandblasting and extrusion honing.

The frangible casting core is designed to fracture under the conditions of the casting process by designing the combination of cast metal and core under parameters including thermal expansion coefficient, elastic (Young's) modulus, casting core porosity, metal yield strength, and casting core flexural strength and fracture toughness.

The core is formed of a material that can survive the temperatures of the casting process including ceramics, plastics, resins, solid salt or other minerals, and refractory metal alloys. In an embodiment, the ceramic may be, but is not limited to an oxide, carbide, nitride or boride In an embodiment, the core may be a ceramic oxide such as alumina ($Al_2O_3$), Silica ($SiO_2$), magnesium oxide (MgO), or Chromite ($Cr_2O_3$). Cores may be fabricated using a variety of ceramic manufacturing techniques including additive manufacturing, replication casting, gel casting, powder processing methods, and machining from porous ceramic foams.

The thermal expansion coefficient of the material used to form the core is selected to ensure isostatic pressure sufficient to fracture the casting cores into debris results from the casting process and materials. In an embodiment, the thermal expansion coefficient of core material may be between 25% and 75% of the thermal expansion coefficient of the metal alloy. In an embodiment, the thermal expansion coefficient of core material may be between $7\times10^{-6}$ and $9\times10^{-6}$ m/m-° C.

The porosity of the core is designed to ensure brittle fracture occurs during the isostatic loading of the cooling process to break the core into debris loosely filling the passageway and small enough to be easily flushed from the passageway. Research has shown that very dense structures exhibit elastic behavior and will fracture while still filling the passage. Highly porous structures exhibit cellular behavior with localized crushing of ligaments deforming the structure without breaking it apart. Porosity also influences the fracture strength of the core, with porosities of 50% resulting in a fracture strength only 10% that of the solid material. In an embodiment, the porosity of the core is between 20% and 60%. In an embodiment, the porosity of the core is between 30% and 50%.

The metal around the core must be sufficiently thick to remain below the elastic limit during the cooling process while developing isostatic pressures high enough to fracture the casting cores. If the surrounding metal is too thin it will deform elastically, plastically, or create hot tears in the metal at the surface of the core. In an embodiment, the metal thickness around the core is equal to or greater than the characteristic width (or diameter) of the casting core.

The casting core segment aspect ratio is the ratio of the length of a casting core segment between any two connection points in a casting core network and the characteristic width (or diameter) of the casting core. Larger aspect ratios allow for more complex internal geometry with longer, thinner passageways, but these spans must also survive the dynamic forces of liquid metal infiltration into the mold. In an embodiment, the casting core segment aspect ratio is less than 10:1. In an embodiment, the casting core segment aspect ratio is less than 4:1.

FIGS. 1-7D illustrate the sequence of steps for the casting process. As can be seen in FIG. 1, the first step of the casting process is the disposition of a frangible core in a mold cavity or mold. In this illustration, the core is simplified and shown as a cylinder. In other embodiments, the core may include other geometric pathways, and/or may be a tortuous pathway. In other embodiments, one or more cores may be used.

Figure 2:
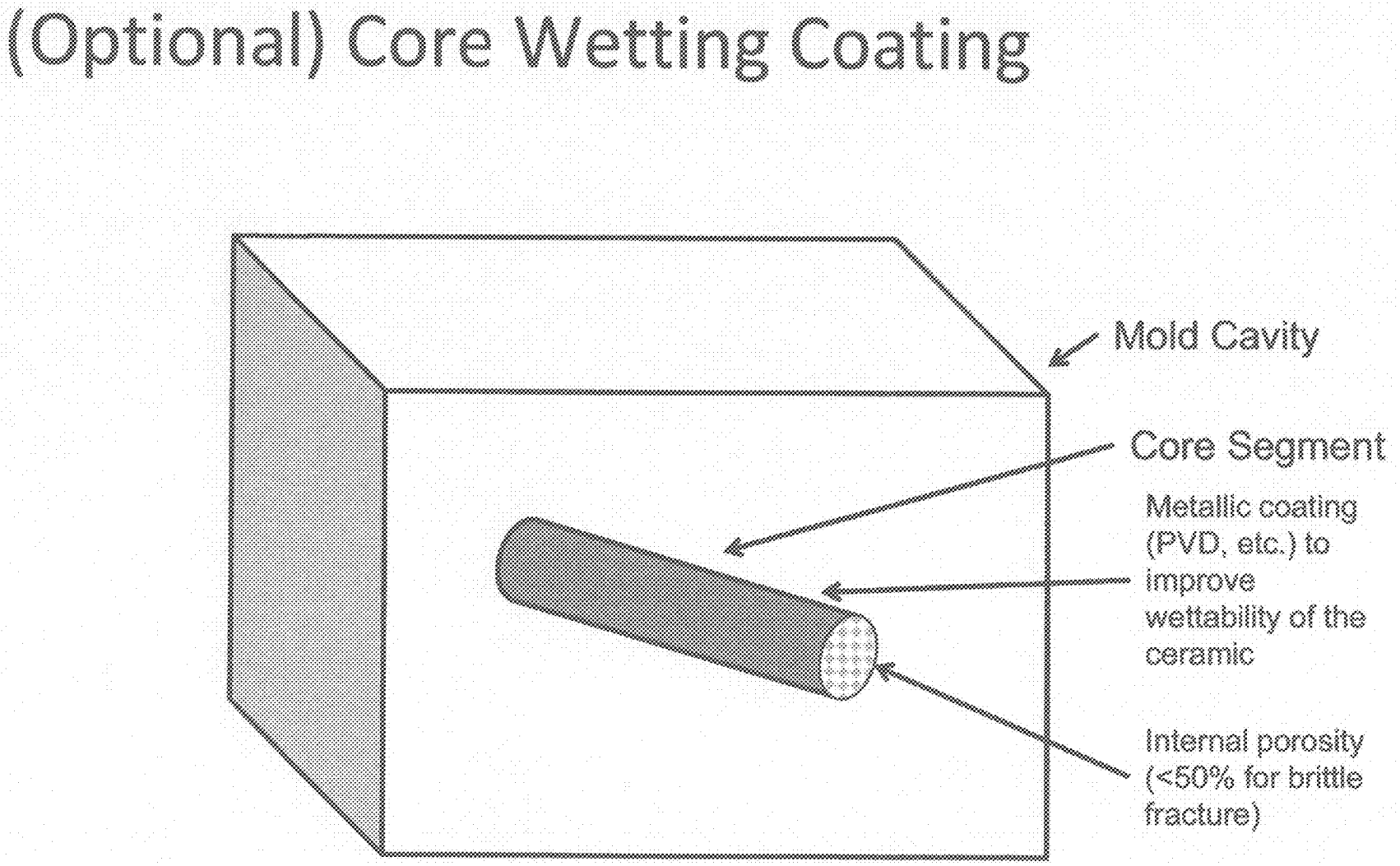
FIG. 2 illustrates an optional first step of the casting process according to an embodiment of the disclosure.

The casting cores are design and fabricated with internal porosity while retaining little or no porosity on the surface. As shown in FIG. 2, the casting core may optionally be coated with a metal alloy to improve wetting of the core surface by molten metal.

Figure 3:
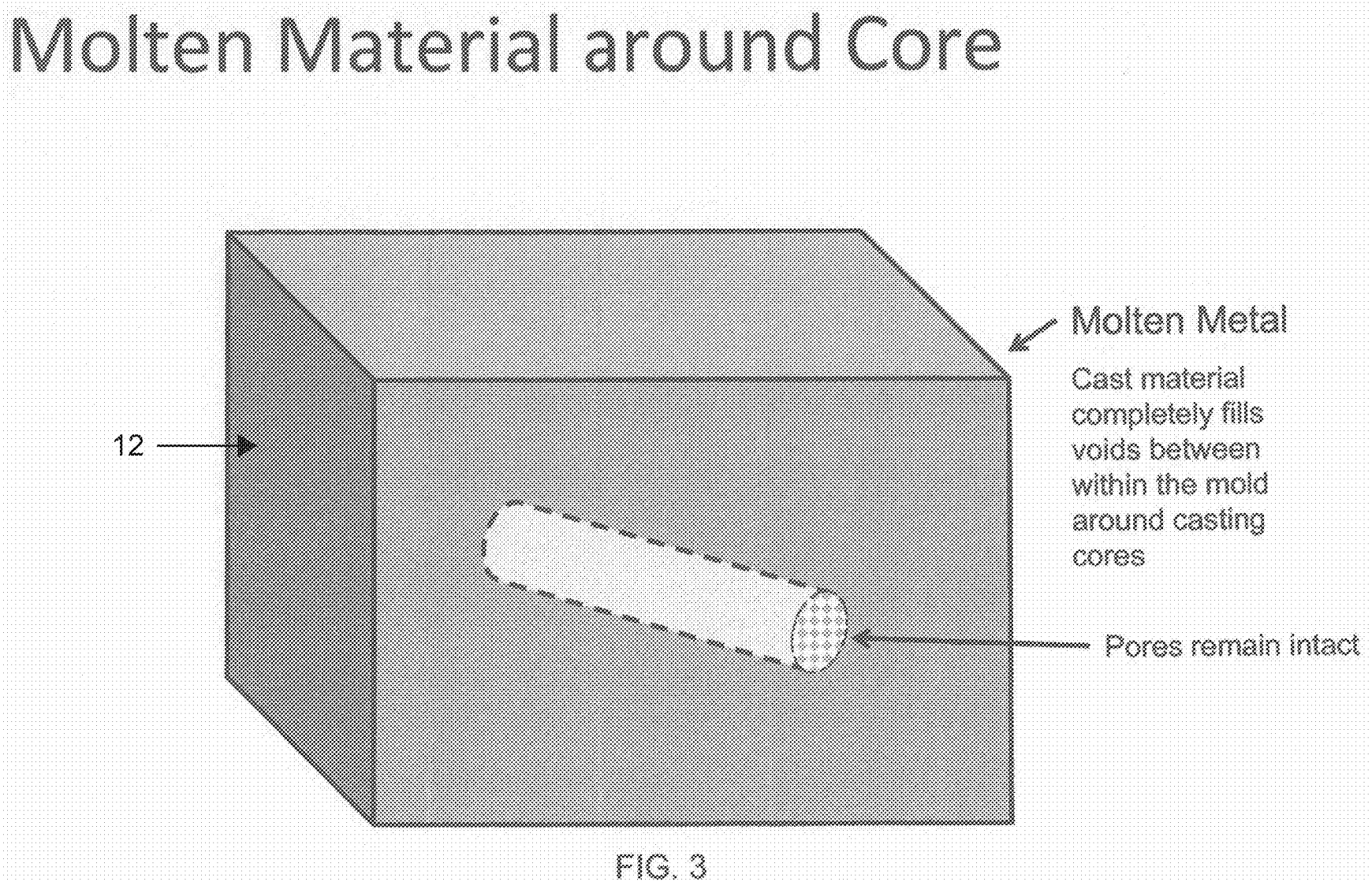
FIG. 3 illustrates a second step of the casting process according to an embodiment of the disclosure.
Figure 4:
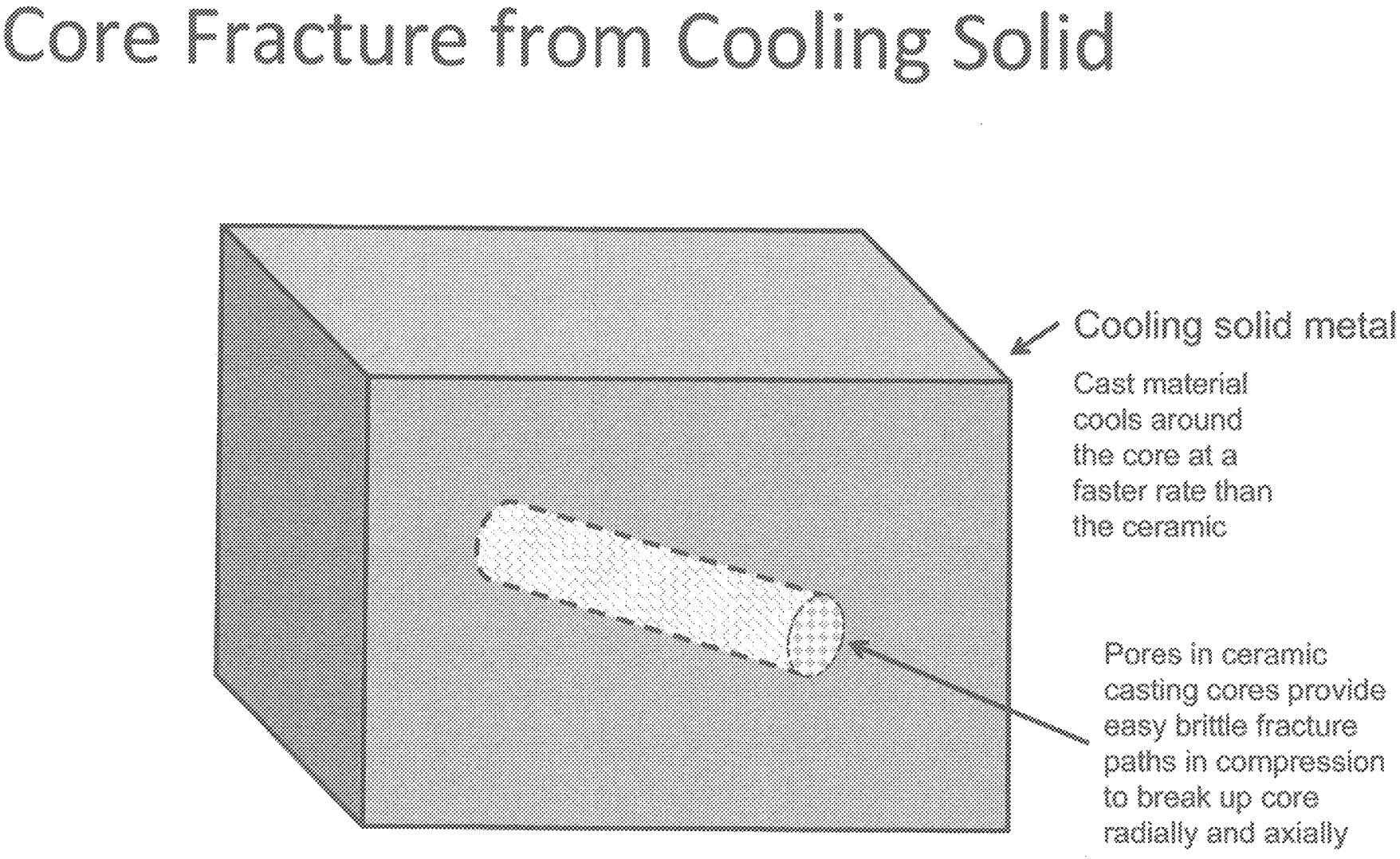
FIG. 4 illustrates a third step of the casting process according to an embodiment of the disclosure.

In FIG. 3, a molten casting material is introduced or cast into the mold 12 to completely fill the void space around the casting core material within the casting material In FIG. 4, the cooling solid metal around the casting cores imposes a thermal strain on the core similar to an isostatic pressure due to dissimilar rates of thermal expansion between the metal and core material. The core fractures into pieces radially and axially based on the fracture paths provided by internal pores to loosely fill in the passageway created by the core.

Figure 5:
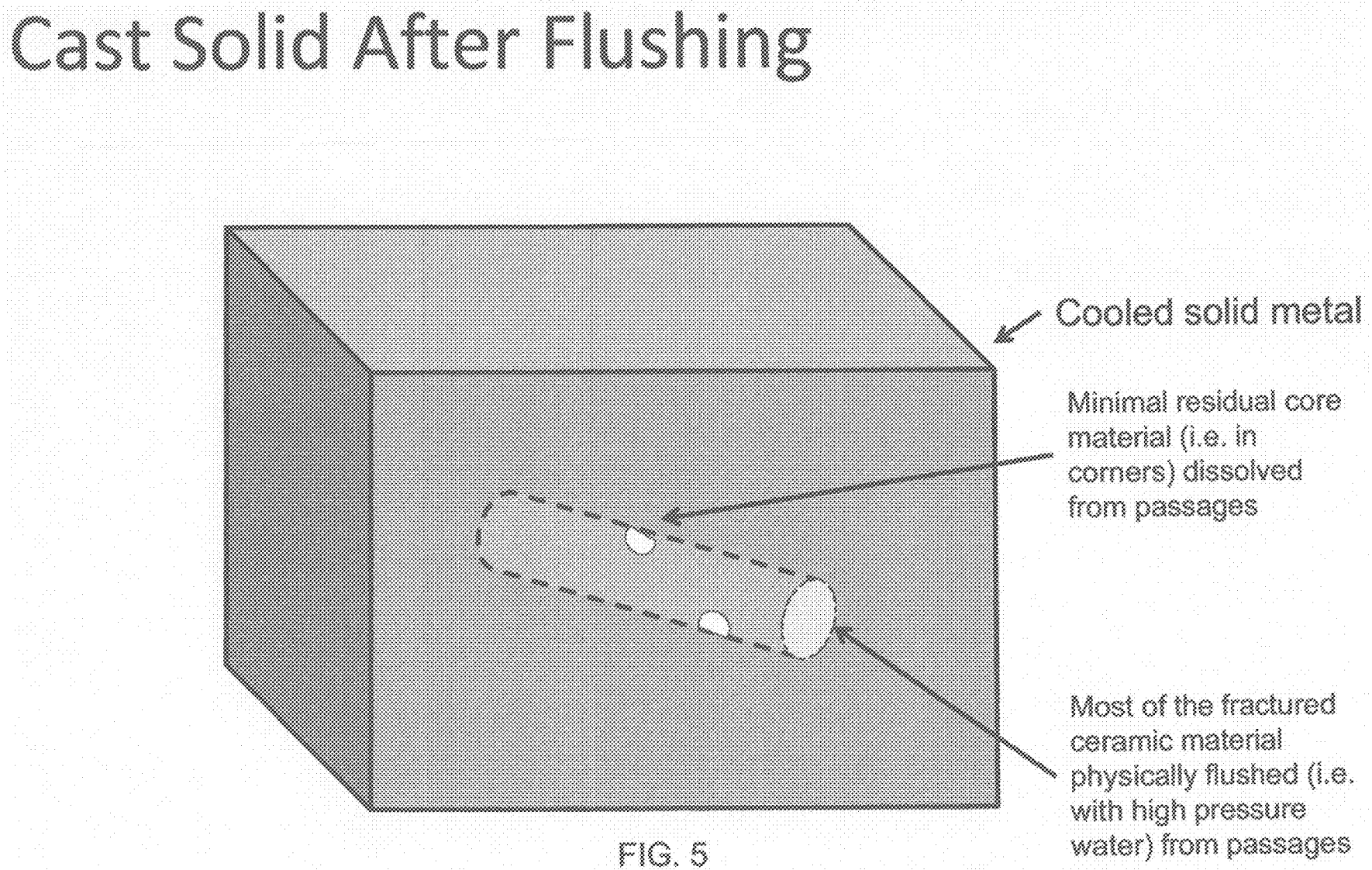
FIG. 5 illustrates a fourth step of the casting process according to an embodiment of the disclosure.
Figure 6:
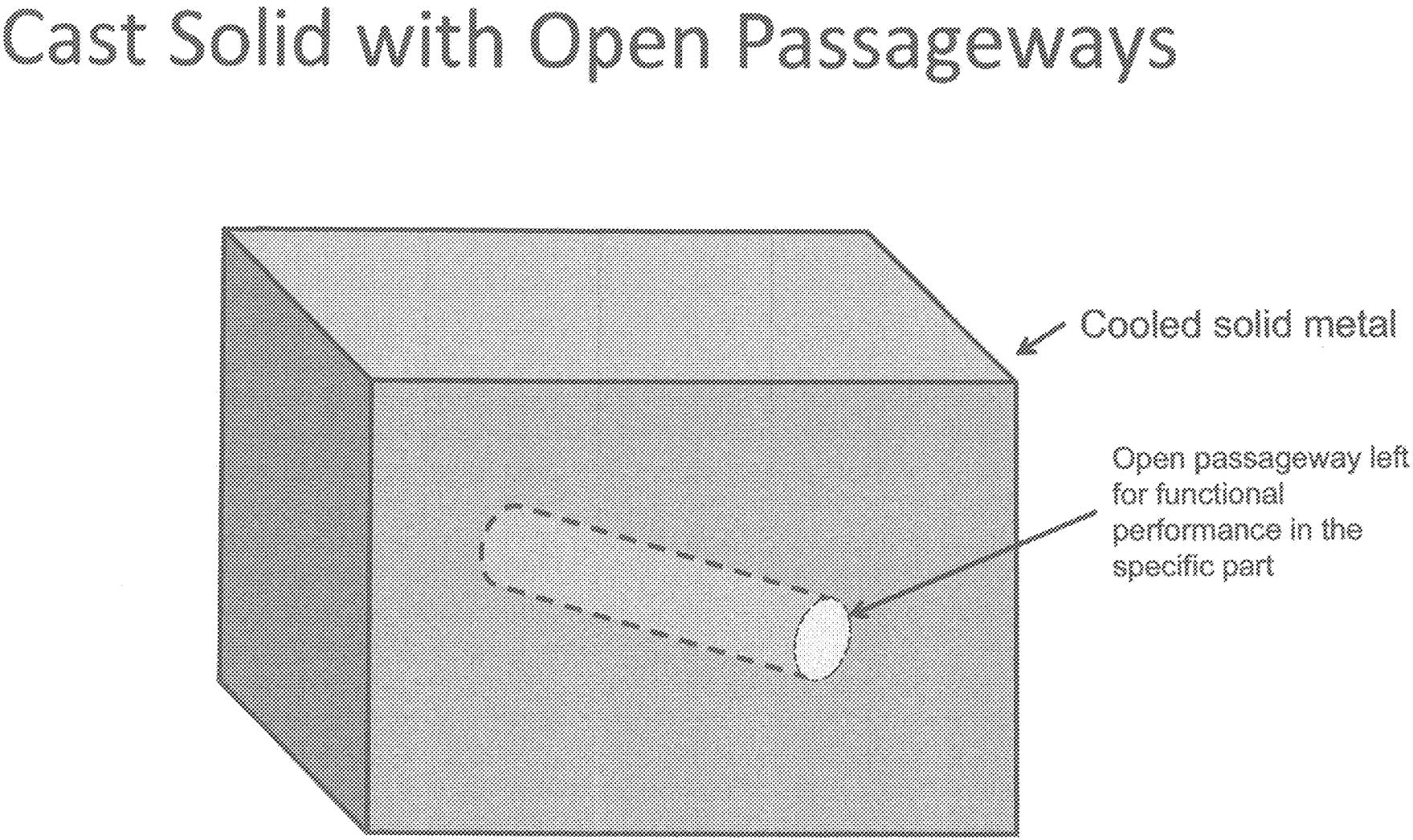
FIG. 6 illustrates a fifth step of the casting process according to an embodiment of the disclosure.

In FIG. 5, the fractured casting core debris is removed from the article while minimal residual material remaining (i.e., in corners) is dissolved from the passages. In an embodiment, the fractured casting core debris is flushed from the article using high pressure water In FIG. 6, the final cast article is left with a long, thin, internal geometry suitable to the application.

Figure 7:
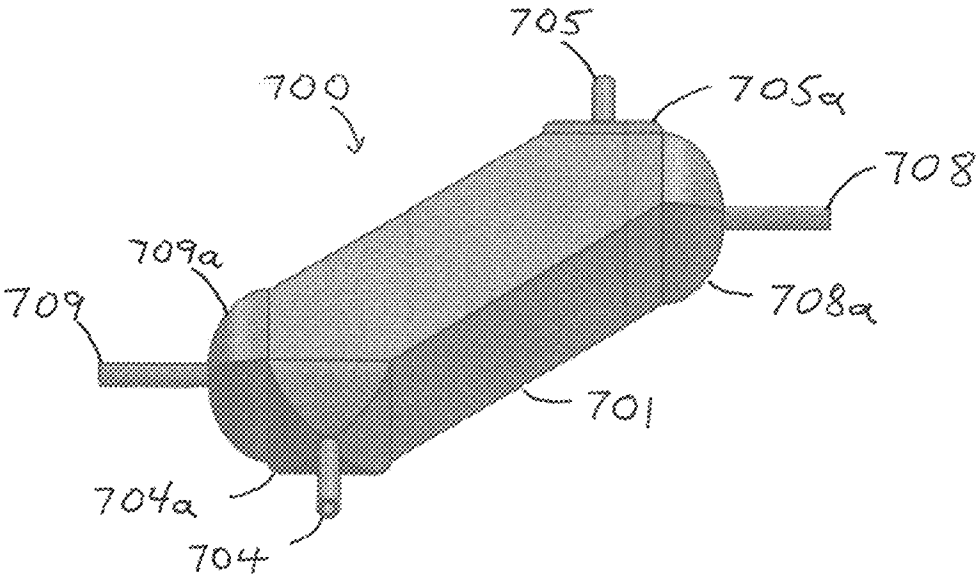
FIG. 7 illustrates a cast heat exchanger formed by the casting process according to an embodiment of the disclosure.

FIG. 7 shows a cast heat exchanger 700 formed by the casting process according to an embodiment of the disclosure. In this example, the heat exchanger includes a heat exchanger body 701, hot fluid inlet 704, hot inlet header 704*a*, hot fluid outlet 705, hot outlet header 705*a*, cold fluid inlet 708, cold inlet header 708*a*, cold fluid outlet 709 and cold outlet header 709*a*.

Figures 7A, 7B, 7C:
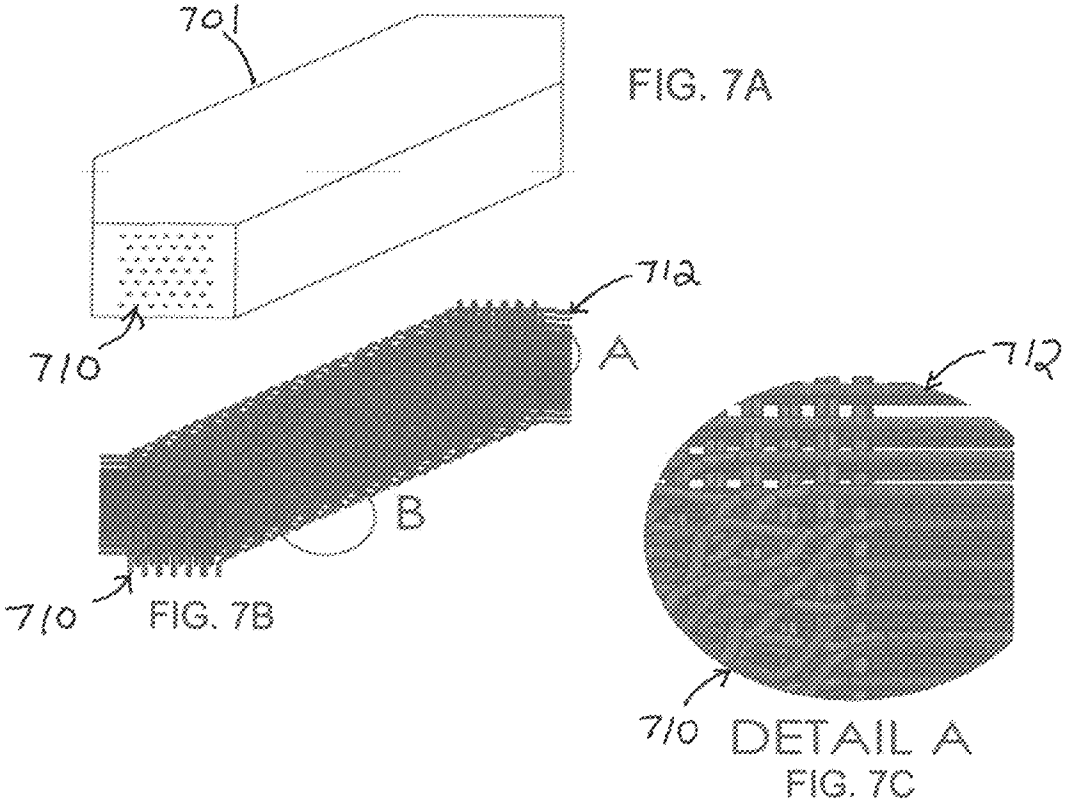
FIG. 7A is an illustration of the body of the cast heat exchanger of FIG. 7.
FIG. 7B is an illustration of the internal passageways of the body of the cast heat exchanger of FIG. 7A
FIG. 7C is an illustration of an exploded view of a portion "A" of the internal passageways of FIG. 7B

FIG. 7A is an illustration of the body of the cast heat exchanger of FIG. 7. As can be seen in FIG. 7A, the body 701 includes a plurality of hot fluid passageways 710. Cold fluid passageways are present on the adjacent front surface but are hidden in this view, but shown on FIG. 7B FIG. 7B is an illustration of the internal passageways of the body of the cast heat exchanger of FIG. 7A. FIG. 7B shows both the hot fluid passageways 710 and cold fluid passageways 712. As can be seen in FIG. 7B, the hot and cold fluid passageways are complex, interwoven, thin shapes within the body.

FIG. 7C is an illustration of an exploded view of a portion "A" of the internal passageways of FIG. 7B that further shows the complexity of the hot and cold fluid passageways 710, 712.

Figure 7D:
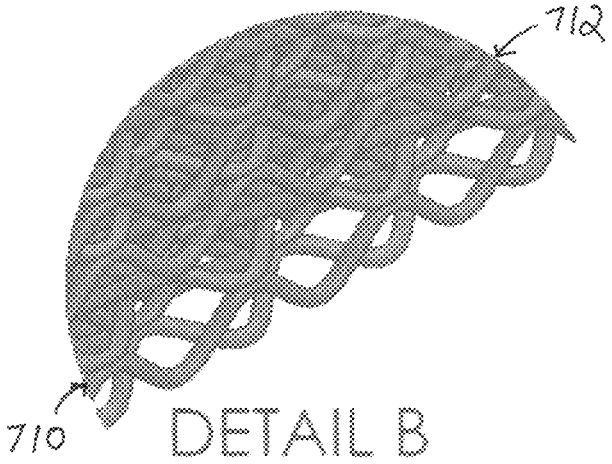
FIG. 7D is an illustration of an exploded view of portion "B" of the internal passageways of FIG. 7B.

FIG. 7D is an illustration of an exploded view of portion "B" of the internal passageways of FIG. 7B that further shows the complexity of the hot and cold fluid passageways 710, 712.

In summary, in the embodiment described above, a casting is fabricated by processes including the following steps:

1. Porous ceramic casting cores are formed
2. Molten metal fills around the casting cores
3. Difference in expansion coefficients crushes cores
4. Fractured core is removed to create a casting having a cleared channel.

The casting cores disclosed are distinct from conventional casting cores in that they are designed with porosities in a specific range to meet competing needs during the casting process. Initially, the casting core network must be strong enough to be self-supporting within the mold or supported by pins that remain in the cast part with loading due to the weight of the casting core network and possibly due to the added effective weight during centrifugal casting. The casting core network must also be strong enough to survive the melt infiltration (metal casting) process including low dynamic forces of liquid metal flow. This requires that the casting cores retain sufficient flexural strength to maintain a truss network with a maximum segment aspect ratio and therefore each casting core segment cannot be too porous. However, the casting cores must also experience brittle fracture into debris loosely filling the resulting passage during the cooling process after the melt solidifies under isostatic pressure loading resulting from the larger thermal expansion coefficient of the solid metal as compared with the casting core material. Each casting core segment must therefore be porous enough to weaken the segment geometry under isostatic pressure loading, provide enough dead space such that fractured materially loosely fills the passageway, and to ensure brittle fracture through the casting core segment rather than cellular or elastic behavior.

The invention being thus described, it will be obvious that the same may be varied in many ways. Such variations are not to be regarded as a departure from the spirit and scope of the invention, and all such modifications as would be obvious to one skilled in the art are intended to be included within the scope of the appended claims. It is intended that the scope of the invention be defined by the claims appended hereto. The entire disclosures of all references, applications, patents and publications cited above are hereby incorporated by reference.

In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A method of forming a component, comprising:

forming a core comprising a core material, the core comprising a plurality of segments, the plurality of segments comprising a surface, a porosity of between 20% and 60%, the plurality of segments having a length between any two segment connection points and a width, the ratio of length between any two segment connection points to width having a ratio of less than 10:1;

heating a cast material to form a heated cast material;

casting the heated cast material around and in direct contact with the core, wherein the heated cast material has a thickness around each segment of the plurality of segments that is at least equal to the width of each segment;

cooling the heated cast material whereby the difference in the coefficients of thermal expansion between the cast material and the core material causes the cast material to apply pressure to the core causing the core to fracture to form a fractured core; and removing the fractured core to form a plurality of connected passageways within the component;

wherein the thermal expansion coefficient of the core is at most 80% that of the cast material.

2. The method of claim 1, wherein the core material is selected from the group consisting of ceramics, plastics, resins, solid salts, minerals, and refractory metal alloys.

3. The method of claim 1, wherein the core material is a ceramic.

4. The method of claim 3, wherein the ceramic is selected from the group consisting of alumina, silica, magnesium oxide and chromite.

5. The method of claim 1, wherein the thermal expansion coefficient of the core material is at most 80% that of the cast material.

6. The method of claim 1, wherein the cast material is a metal alloy.

7. The method of claim 1, wherein removing the fractured core is by a core removal process selected from the group consisting of mechanical flushing, dissolution, flushing by a liquid, wherein the liquid contains particles, and extrusion honing.

8. The method of claim 1, wherein the surface of the plurality of segments has no porosity.

* * * * *